US011655545B2

(12) United States Patent
Piette et al.

(10) Patent No.: US 11,655,545 B2
(45) Date of Patent: May 23, 2023

(54) METHOD AND DEVICE FOR IMPROVING THE SURFACE CONDITION OF A TURBOMACHINE COMPONENT

(71) Applicant: SAFRAN AIRCRAFT ENGINES, Paris (FR)

(72) Inventors: Romaric Jean-Marie Piette, Moissy-Cramayel (FR); Françoise Bertrand, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 3 days.

(21) Appl. No.: 17/264,482

(22) PCT Filed: Jul. 31, 2019

(86) PCT No.: PCT/FR2019/051881
§ 371 (c)(1),
(2) Date: Jan. 29, 2021

(87) PCT Pub. No.: WO2020/025902
PCT Pub. Date: Feb. 6, 2020

(65) Prior Publication Data

US 2021/0317585 A1 Oct. 14, 2021

(30) Foreign Application Priority Data

Jul. 31, 2018 (FR) ..... 1857121

(51) Int. Cl.
*C23F 3/06* (2006.01)
*C23F 1/26* (2006.01)
*C23F 1/28* (2006.01)
*F01D 25/00* (2006.01)

(52) U.S. Cl.
CPC ..... *C23F 3/06* (2013.01); *C23F 1/26* (2013.01); *C23F 1/28* (2013.01); *F01D 25/00* (2013.01); *F05D 2230/10* (2013.01)

(58) Field of Classification Search
None
See application file for complete search history.

(56) References Cited

U.S. PATENT DOCUMENTS

2013/0161297 A1 6/2013 Czerner
2015/0013126 A1 1/2015 Czerner

FOREIGN PATENT DOCUMENTS

EP 2 377 423 A1 10/2011
EP 2 511 398 B1 8/2016

*Primary Examiner* — Allan W. Olsen
(74) *Attorney, Agent, or Firm* — Birch, Stewart, Kolasch & Birch, LLP

(57) ABSTRACT

The invention concerns a method for the surface treatment of a component, for example a turbomachine component, the component comprising a surface to be treated, the method comprising the following steps: loading a first dispenser with a chemical etching solution and a second dispenser with a rinsing solution, positioning the first dispenser and the second dispenser opposite the surface to be treated, moving the first dispenser and the second dispenser along the surface to be treated, such that the surface to be treated successively receives the chemical etching solution followed by the rinsing solution.

11 Claims, 6 Drawing Sheets

METHOD AND DEVICE FOR IMPROVING THE SURFACE CONDITION OF A TURBOMACHINE COMPONENT

TECHNICAL FIELD OF THE INVENTION AND STATE OF THE ART

The present invention concerns the surface treatment of turbomachine parts, preferably metal parts, in order to improve their surface condition. The invention finds an advantageous application for the surface treatment of turbomachine blades after their machining.

The parts exposed to air flow in a turbomachine are subject to severe aerodynamic performance requirements. One of the determining parameters for the optimization of the operating cycles of the turbomachine is the surface condition of the parts that are directly exposed to air stream. Special attention should be paid to the rotating elements of the turbomachine, in particular to the compressor and turbine blades.

At the end of the operations of standard machining the turbomachine blades, blade surfaces with a roughness Ra of less than 1.6 micrometers are obtained. It is recalled that the roughness Ra designates the mean deviation between successive microscopic peaks and troughs of a surface. A roughness Ra of 1.6 micrometers is, however, still considered too high for some applications.

In order to further reduce the roughness of the blade surfaces, it is known to implement manual or automated polishing with an abrasive band or abrasive paste, or electrolytic polishing. These operations allow in particular reducing the roughness of the surface of the blades or deburring them, that is to say removing a local excess of material that creates a surface unevenness.

It is also known to deburr the machined surface of a part by tribofinishing, by immersing the part in a matrix comprising an abrasive substance, and by setting the part in motion in said matrix. The motion of the part generates friction between the abrasive substance and the surface of the part. Among the machines known for automating such a tribofinishing treatment, some comprise a bin filled with abrasive product and driven by an oscillatory or vibratory motion. Other known devices provide means for rotating the parts to be treated, within a fixed matrix comprising the abrasive substance.

However, the known methods have the drawback of being able to be adapted with great difficulty to treat only one portion of a part. In the case of the turbomachine blades, some applications only require localized treatment of the blades at the leading edge and/or trailing edge, which are the most critical areas for the aerodynamic performance of the blade. Even though only a localized treatment of a part would be necessary, the known polishing or tribofinishing machines do not allow reducing the treatment duration and exclusively targeting some portions of the surface of a part.

In addition, for a machine providing the immersion of the parts to be treated in a matrix of abrasive product, said matrix must comprise a large amount of abrasive product, and possibly a solid medium to communicate the motion of the machine to the matrix. Such a machine thus consumes more abrasive product than it is necessary to treat the parts, and requires additional material to form the solid medium. Finally, some areas of the parts are inaccessible during a tribofinishing treatment.

GENERAL PRESENTATION OF THE INVENTION

There is therefore a need for a method for the surface treatment of parts, in particular metal parts after machining, which is automated to guarantee the reliability and repeatability of the results, while allowing only localized treatment of the parts to be carried out, in order to target critical surfaces possibly inaccessible with the known methods.

There is also a need for a surface treatment method of increased speed compared to the known methods.

There is an additional need for a method that consumes little abrasive product.

The present invention meets these needs by providing a method for the surface treatment of a part, for example a turbomachine part, the part comprising a surface to be treated, the method comprising the following steps:

- charging a first dispenser with a chemical etching solution and a second dispenser with a rinsing solution,
- positioning the first dispenser and the second dispenser facing the surface to be treated,
- moving the first dispenser and the second dispenser along the surface to be treated, so that the surface to be treated successively receives the chemical etching solution and then the rinsing solution.

In the method of the invention, the surface to be treated is first chemically etched to reduce its roughness, and then rinsed. The rinsing immediately following the chemical etching allows recovering the residues detached from the surface, as well as the excess of etching solution.

The method of the invention has the advantage of allowing a localized treatment, targeting a specific area of a part to be treated. Controlling the movement of the two dispensers allows to treat this particular area. In addition, the treatment method can be very fast when the surface to be treated is small.

Finally, the method consumes only the amounts of chemical etching solution and rinsing solution necessary for charging the two dispensers, and does not require any additional solid medium in addition to the chemical etching solution.

Other optional and non-limiting characteristics of a method of the invention are as follows, taken alone or in any of the technically possible combinations:

- the first dispenser and the second dispenser are positioned and moved relative to the surface to be treated so that the second dispenser is positioned in the wake of the first dispenser to apply the rinsing solution in the areas of the surface to be treated that have just received the chemical etching solution;
- the first dispenser and the second dispenser each comprise a roller, a paintbrush or a brush, and the positioning step comprises bringing the first dispenser and the second dispenser into contact with the surface to be treated of the part;
- the first dispenser and the second dispenser are continuously charged respectively with the chemical etching solution and with the rinsing solution so as to remain impregnated during the application;
- the chemical etching solution is a solution with an acidic pH less than 5 or a basic pH greater than 9;
- the application step lasts between 1 and 10 seconds per square millimeter of the surface to be treated.

The invention relates, according to a second aspect, to a device for a method as defined above for the surface treatment of a part, in particular of a turbomachine part, said part comprising a surface to be treated and the device comprising:

- a first dispenser configured to distribute a chemical etching solution,
- a second dispenser configured to dispense a rinsing solution, a support configured to hold the first dispenser in position relative to the second dispenser and allow their joint movement, movement means configured to allow simultaneous movement of the first dispenser and of the second dispenser along the surface to be treated so that the surface to be treated first receives the chemical etching solution and then the rinsing solution, and a sealed casing in which the first and second dispensers are positioned and configured to ensure sealing between the surface to be treated and the rest of the areas of the part located out of the surface to be treated.

Other optional and non-limiting characteristics of said device are as follows, taken alone or in any of their technically possible combinations:

the device further comprises means for conveying a chemical etching solution at the first dispenser, means for conveying a rinsing solution at the second dispenser and means for controlling a flow rate of the chemical etching solution and a flow rate of the rinsing solution;

the first dispenser and the second dispenser each comprise a roller, and the device further comprises a recovery bin configured to recover an excess of chemical etching solution and an excess of rinsing solution at the outlet of the chemical etching roller and of the rinsing roller.

GENERAL PRESENTATION OF THE FIGURES

Other characteristics, aims and advantages of the invention will emerge from the following description, which is purely illustrative and not restrictive, accompanied by the appending drawings, among which:

FIG. 1*a* schematically represents a device for implementing a method of the invention, seen from above, during the treatment of a surface to be treated of a part;

FIG. 1*b* schematically represents the same device after the treatment of the surface to be treated;

FIG. 2 schematically represents the device of FIGS. 1*a* and 1*b*, in a perspective view;

Figure 5A:
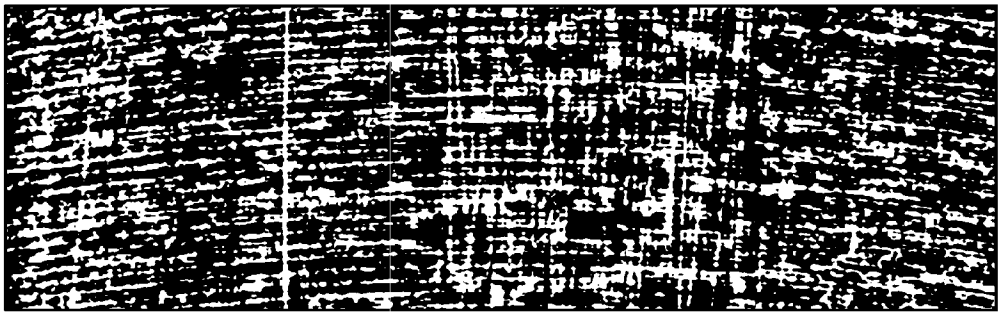
Figure 5B:
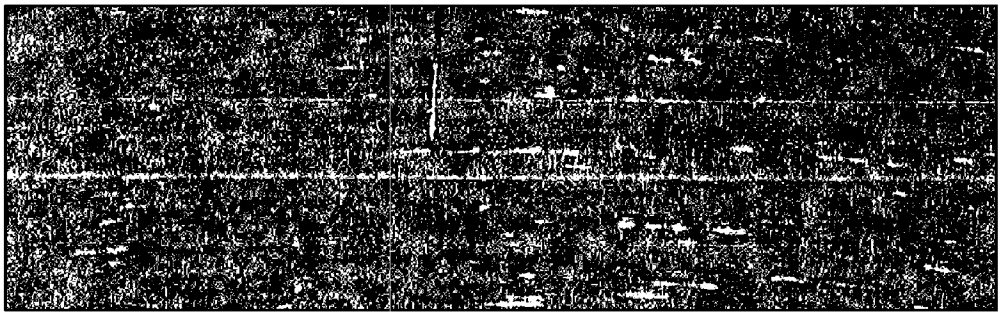

FIG. 5*a* is a microscopic view of the surface of a part before a surface treatment according to the invention;

FIG. 5*b* is a microscopic view of the same surface after a surface treatment according to the invention.

DETAILED DESCRIPTION

In the following, a method for the surface treatment by chemical etching according to the invention, applied to a metal blade of a turbomachine, and a device configured to implement said method, are described.

However, those skilled in the art will understand that the method of the invention is applicable with the same advantages for any type of part that may be the object of a surface treatment by chemical etching, in particular in order to reduce the roughness of such a part, or to deburr it.

On the other hand, the case where the first dispenser dispensing chemical etching solution is a chemical etching roller and where the second dispenser dispensing the rinsing solution is a rinsing roller is described below. However, it will be understood that the two said dispensers can have any structure allowing contact with a surface to be treated of a part, and the application of a chemical etching or rinsing solution. A first dispenser or a second dispenser may in particular take the form of a paintbrush or a brush.

In the drawings, similar elements correspond to identical reference numerals.

Device for the Surface Treatment of a Part

Figure 1A:
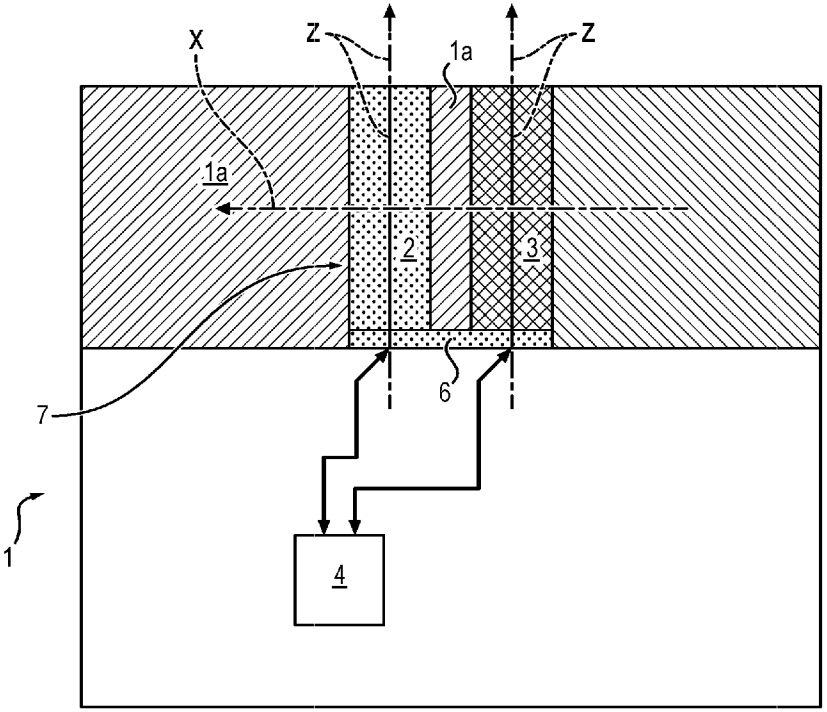
Figure 1B:
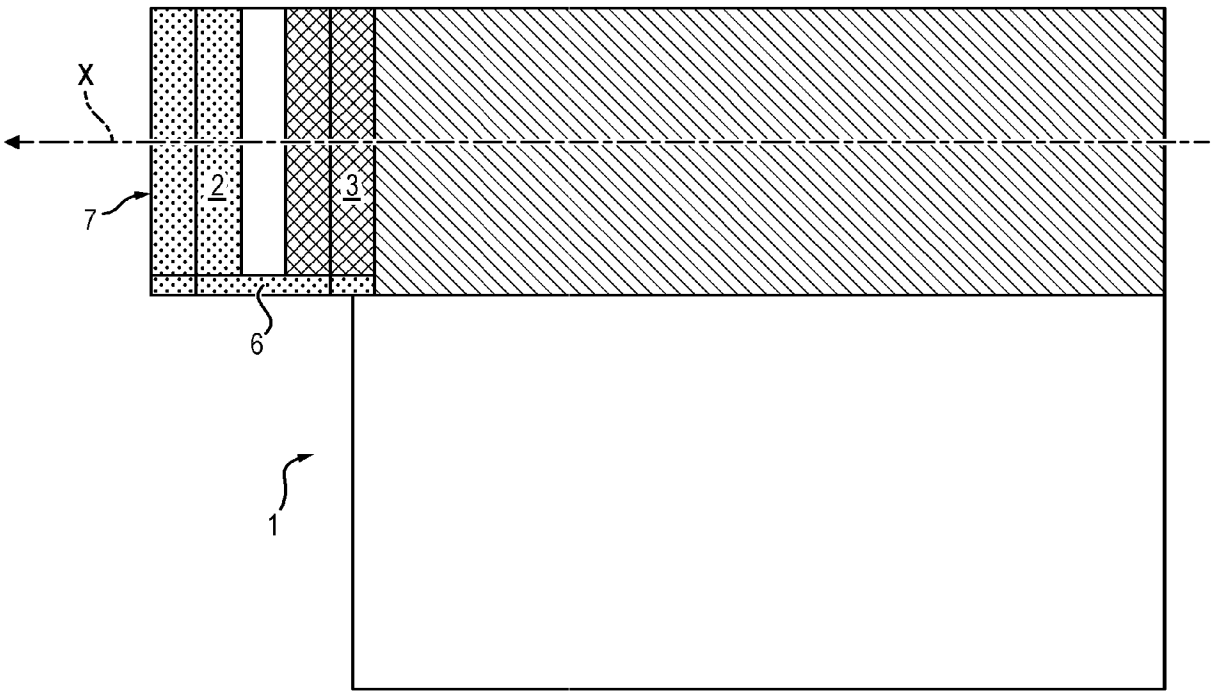

FIGS. 1*a* and 1*b* schematically represent an automatic surface treatment machine according to the invention. In the view of FIG. 1*a*, a surface 1 of a turbomachine blade is being treated by a chemical etching roller 2 and a rinsing roller 3. During the treatment, the two rollers 2 and 3 are driven along the surface 1, by a movement means 4, along a direction of movement X, in the direction from the right to the left (from the rinsing roller 3 to the chemical etching roller 2). Thus, the treated area of the surface 1 lies to the right of the rollers 2 and 3 in the figures, and the area that remains to be treated lies to the left of the rollers 2 and 3. In the view of FIG. 1*b*, the surface 1 has already been treated.

Advantageously, the surface 1 to be treated of the turbomachine blade approximates the trailing edge or the leading edge of the blade. In general, the method which will be described below is advantageously applied to reduce the roughness of the surfaces most exposed to the primary or secondary air stream in the turbomachine.

In this example, the rollers 2 and 3 are of cylindrical tubular shape, and both have symmetry of revolution along axes parallel to the same Z-axis. The rollers 2 and 3 are advantageously arranged within a sealed casing 7 and positioned side by side within said casing. The sealing of the casing 7 allows limiting the area of the part that receives the chemical etching solution and the rinsing solution to the area to be treated, in particular if the area to be treated has a small surface compared to the total surface of the part. In addition, the sealed casing 7 contains any projections of chemical etching solution that could otherwise reach operators. When the casing 7 is positioned against a surface of a part, an outer portion 20 of the roller 2 and an outer portion 30 of the roller 3 abut against said surface.

Preferably, the rollers 2 and 3 are arranged to be able to be partially contiguous simultaneously against such a surface over substantially their entire length, in order to come into contact with said surface. By "outer portion" of the rollers is meant the radially farthest portion from the axes of revolution of the rollers. The outer portion 20 of the roller thus extends around an inner portion 21 of the roller 2, and the outer portion 30 of the roller extends around an inner portion 31 of the roller 3. The rollers 2 and 3 can advantageously be made up of several radially superimposed lamellae. In this example, the rollers 2 and 3 extend parallel to each other, along their axes of revolution, and are slightly spaced apart from each other.

In this example, the edges of the rollers 2 and 3 (corresponding, in FIGS. 1*a* and 1*b*, to the upper portion and the lower portion of said rollers) are aligned along a direction of alignment X. In the present example, the direction of alignment X is orthogonal to the axes of revolution of the rollers; alternatively, the direction of alignment could make an angle relative to the X direction of the figures.

The material of the lamellae of the chemical etching roller 2 is chosen so that it can be soaked with a chemical etching solution. By "chemical etching solution" is meant a solution having an abrasive character, capable of smoothing the surface of a part, in particular a metal part, upon friction with said surface. Such a solution is able, when the roller 2 rubs against the surface 1, to locally etch the superficial layers in order to flatten the surface. Preferably, the chemical etching solution is acidic (with a pH of less than 5) or basic (with a pH greater than 9).

The solution can comprise the following dosage for one liter: 500 milliliters of 95% ethyl alcohol, 500 milliliters of 35% hydrochloric acid, 20 grams of copper chloride, in particular if the part to be treated is a nickel-based part.

Otherwise, the solution can comprise the following dosage for one liter: 700 milliliters of deionized water, 150 milliliters of 40% hydrofluoric acid, 150 milliliters of 60% nitric acid, in particular if the part to be treated is a titanium-based part.

Generally, the chemical etching solution preferably comprises nitric acid and/or picric acid and/or hydrochloric acid.

The lamellae of the roller 2, in particular those of the outer portion 20 of the roller, are preferably made of a sponge material. This type of material has the advantage of not being etched and worn away by an abrasive substance. The lamellae can be made of plastic material, for example polypropylene. Alternatively, the lamellae of the roller 2 can be made of cotton.

The material of the lamellae of the rinsing roller 3 is chosen so that they can be soaked with a rinsing liquid. The roller 3 can be for example a rotating microfiber brush. The material of the roller 3 may be spongy.

The device further includes a movement means 4 configured to drive the rollers 2 and 3 in rotation about their respective axes of revolution. The movement means 4 is also configured to drive the rollers 2 and 3 in translation. Alternatively, the device may include means separate from the movement means 4 for driving the rollers 2 and 3 in translation. Means for mechanically driving the rollers are well known to those skilled in the art and will not be detailed here.

The device further includes a support, not represented in the figures, for holding the roller 2 in position relative to the roller 3 and allowing the joint movement of the two rollers.

The device also advantageously includes a recovery bin 6, advantageously located in the sealed casing 7. The bin 6 is arranged in the vicinity of the rollers 2 and 3 so as to recover the chemical etching residues generated by the passage of the roller 2, and the possible excess of chemical etching solution and/or rinsing solution. In the present example, the recovery bin 6 is arranged against a face of the sealed casing 7 perpendicular to the contact face of the portions 20 and 30 with a part, and covers the entire said face. A space is arranged between the aligned planar faces of the two rollers 2 and 3 and one face of the sealed casing 7, in which the bin 6 is arranged. The bin 6 is thus positioned at the outlet of the rollers 2 and 3.

The dimensions of the rollers 2 and 3 (and possibly of the sealed casing 7) can be chosen depending on the parts intended to be treated. For a localized treatment of blade surfaces of a turbomachine, the rollers 2 and 3 have advantageously a length comprised between 5 and 500 millimeters, preferably between 10 and 100 millimeters. The rollers are then adapted to treat surfaces with a dimension comprised between 1 $mm^2$ and 100 $mm^2$, preferably between 5 $mm^2$ and 15 $mm^2$. Preferably, the rollers 2 and 3 are of the same shape and of the same dimensions. They have dimensions smaller than a dimension of the part to be treated.

Figure 2:
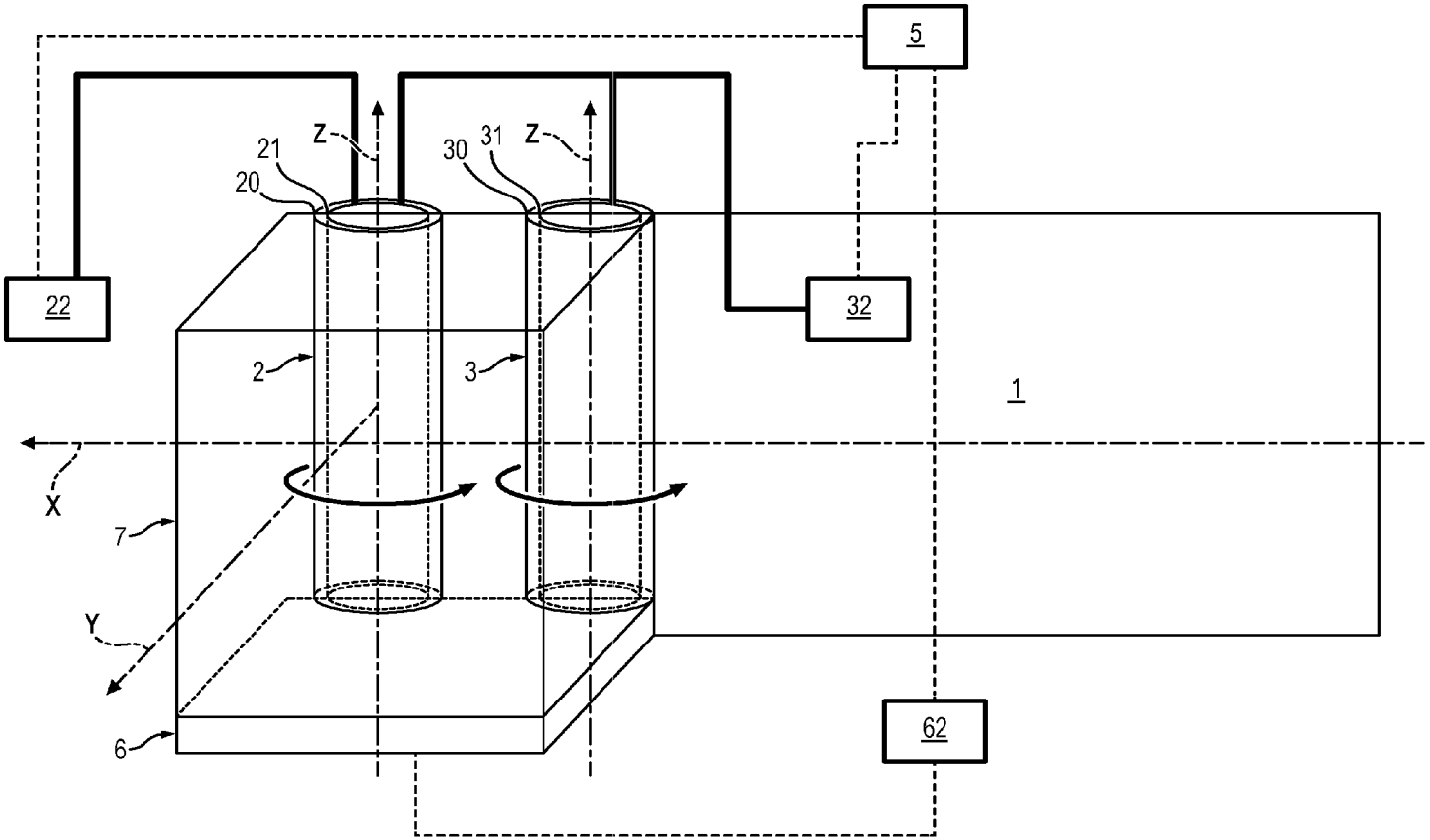

FIG. 2 represents a schematic perspective top view of the machine comprising the sealed casing 7 and the rollers 2 and 3, after treatment of the part 1. For greater clarity, the movement means 4 is not represented in FIG. 2; however, there are represented here means 5 for controlling a system 22 for conveying a chemical etching solution, a system 32 for conveying a rinsing liquid, and a system 62 for discharging the waste accumulated in the recovery bin 6—the elements 5, 22, 32 and 62 are not represented in FIGS. 1*a* and 1*b* for greater readability.

The system 22 may comprise a chemical etching solution reservoir, a pipe, one end of which opens out into the reservoir and the other end of which opens out in the vicinity of the chemical etching roller 2, and a pump for conveying the chemical etching solution from the reservoir to the roller 2. The system 32 may comprise a rinsing solution reservoir, a pipe, one end of which opens out into the reservoir and the other end of which opens out in the vicinity of the rinsing roller 3, and a pump for conveying the rinsing solution from the reservoir to the roller 2. The control means 5 can advantageously comprise a processing unit configured to receive electronic instructions, and configured to control valves associated with the pumps of the systems 22 and 32.

Advantageously, the system 32 also comprises a second branch for supplying the roller 2 with rinsing liquid. This latter configuration has the advantage of facilitating the simultaneous cleaning of the two rollers 2 and 3 after a treatment cycle. In addition, this configuration allows injecting a well-chosen flow rate of rinsing liquid at the roller 2 during the treatment, so as to clean the roller 2. Too much clogging of the roller 2 caused by the chemical etching solution has the effect of damaging the superficial layers of the roller 2.

The waste discharge system 62 can be connected to the recovery bin 6 by means of a pipe, one end of which opens out into the bin 6. The system 62 can be provided with an air pump to allow the suction of the content of the bin 6, in order to empty the bin 6.

Method for Surface Treatment by Chemical Etching

Figure 3:
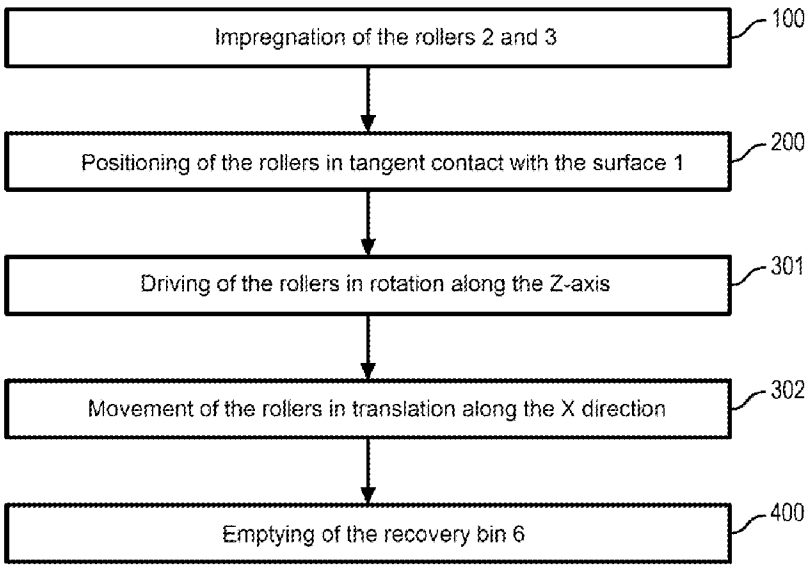
FIG. 3 represents the steps of a surface treatment method according to one embodiment of the invention.

FIG. 3 represents the steps of a method 10 for surface treatment of a turbomachine part according to one embodiment of the invention.

The part comprises one (or more) surface(s) to be treated. Preferably, it is a surface of a metal part, for example made of steel, nickel or titanium. Said surface may have been previously machined, for example milled and/or ground. Indeed, these usual operations are likely to produce localized excess of metal material (for example burrs) on the surface of the parts. In the case of turbomachine blades, the surface of the blades should be smoothed and the burrs should be removed so as to optimize the aerodynamic efficiency of the set of blades. Attempt can also be made to polish the surfaces to be treated.

The method comprises a first step 100 of charging the rollers 2 and 3. In this example, the charging is carried out by partial or total impregnation of the chemical etching roller 2 with a chemical etching solution as defined above, and (in a simultaneous or delayed manner) by partial or total impregnation of the rinsing roller 3 with rinsing solution. It can be provided that only the radially outer portions of the rollers 2 and 3 are impregnated, or alternatively, that all the rollers are impregnated.

Then, during a step 200, the rollers 2 and 3 are positioned facing the part to be treated. The outer portions of the rollers 2 and 3 are positioned against the surface 1*a* without the rotation of the rollers being hampered. The rollers 2 and 3 can be advantageously positioned directly in the vicinity of the surface to be treated.

Advantageously, the side faces of the rollers 2 and 3 are aligned, as in FIGS. 1*a* and 1*b*. There are then two planes of alignment of the rollers, each of these planes comprising a side face of the roller 2 and a side face of the roller 3.

Then, during a step 300, the rollers 2 and 3 move to successively apply the chemical etching solution and the rinsing solution on the surface to be treated. In the present example, step 300 comprises a simultaneous rotational and translational motion of the rollers 2 and 3. For example, it is possible to provide a first sub-step 301 of simultaneously rotating the rollers 2 and 3 about their respective axes of revolution, followed by a second sub-step 302 of driving in translation the two rollers (during the rotation) along a direction of movement X. The translational and rotational motions are communicated to the rollers 2 and 3 by the movement means 4 as described above.

The direction of movement X of the rollers is chosen so that the rollers 2 and 3, impregnated respectively with chemical etching solution and rinsing solution, pass through the surface to be treated during their motion. For an effective surface treatment, the roller 2 passes through the surface first, then the roller 3, located behind the roller 2, passes through the surface immediately after the roller 2 in order to rinse the surface. An advantage of this configuration is that a possible excess of chemical etching solution, as well as the material removed from the surface to be treated by the chemical etching, are immediately removed from the surface of the part, and advantageously conveyed to the recovery bin 6.

Advantageously, the roller 3 lies in the wake of the roller 2, to ensure that the rinsing solution is applied in areas of the surface to be treated that have just received the chemical etching solution. The path of the rollers 2 and 3 during their movement can be controlled by the movement means 4, according to instructions received from a processing unit. The instructions may have been previously selected by a user.

Advantageously, the rollers are continuously supplied respectively with chemical etching solution and rinsing solution, so as to remain impregnated during the simultaneous rotational and translational motion.

Step 300 has preferably a duration that depends on the surface of the part to be treated. For example, step 300 may have a duration from 1 to 10 seconds per square millimeter of the surface to be treated. Step 300 can have a duration comprised between 10 and 300 seconds, preferably between 20 and 60 seconds (at the end of this duration, the rollers 2 and 3 can be repositioned in the vicinity of another surface to be treated during a new step 200, and put back into motion during a new step 300). Such duration is in particular advantageous within the framework of a deburring or polishing of a ridge or a small surface of a part. In general, the duration of the treatment can be selected based on the size of the area to be treated. Conversely, with the treatments known from the prior art such as tribofinishing, the duration of the treatment cannot be reduced, even if it is not necessary to treat the entire part.

As an alternative to moving the rollers 2 and 3 in translation, the rollers 2 and 3 can be driven in rotation without being driven in translation during step 300, and the part can be brought into contact with the rollers 2 and 3 at the surface to be treated and translated along a direction transverse to the rollers.

Finally, in the case where the chemical etching machine implementing the method 10 comprises a recovery bin 6, it is possible to provide for emptying the bin 6 in a step 400.

Figure 4:
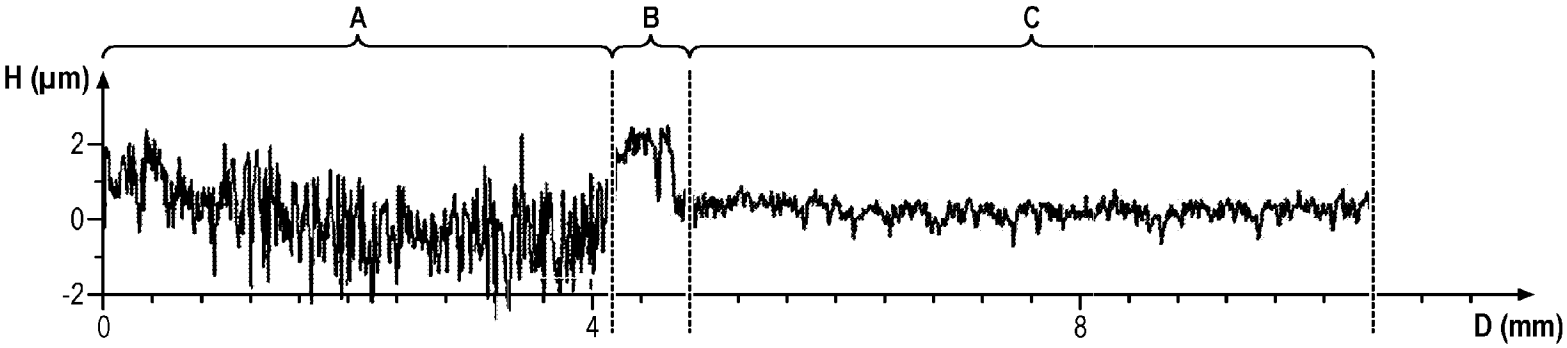
FIG. 4 is a graph whose Y-axis represents the height of the surface of a part, on a microscopic scale, identified with respect to a central line of the part, and whose X-axis represents the distance along a line passing through a treated area of the part and an untreated area of the part.

FIG. 4 represents a height profile of a test piece surface representative of a turbomachine blade, deburred using the method 10. The height of the surface on a microscopic scale is indicated on the Y-axis, the height 0 corresponding to an average of the height of the surface of the part. The test piece is made of nickel base, of Inconel 718 material. For this test, the duration of the chemical etching approximates 35 seconds.

Two separate test piece areas were delimited along a direction corresponding to the direction of movement of the rollers 2 and 3 during step 300. The two test piece areas were separated from each other by a single-sided adhesive tape bonded to the surface of the test piece transversely to the direction of movement of the rollers. During the implementation of the method 10, the rollers pass over only one of the two areas (portion C on the right in FIG. 4), and stop at the level of the adhesive tape (portion B). Thus, the other area (portion A) does not receive a chemical etching solution. The portion A therefore plays the role of a control portion.

It is observed that the chemical etching treatment allows significantly reducing the roughness of the surface of the nickel-based test piece and improving its surface condition. Indeed, the curve portion corresponding to portion C (treated area) has a roughness Ra of 0.20 micrometers, while the curve portion corresponding to portion A (untreated area) has a roughness Ra of 0.64 micrometers.

Furthermore, the amplitude between the point of maximum height and the point of minimum height along the direction of measurement is much smaller for portion C (about 1.5 micrometers) than for portion A (about 4.5 micrometers).

FIG. 5*a* and FIG. 5*b* are top views under a microscope of a surface of the nickel-based test piece, said surface corresponding to portion C of FIG. 4 (area treated using the method 10). FIG. 5*a* corresponds to the surface before treatment, and FIG. 5*b* corresponds to the surface after treatment.

It is observed that, following the passage of the rollers 2 and 3 (FIG. 5*b*), the height variations are much less marked than before the passage of the rollers. The surface condition of the test piece is much more satisfactory.

The method of the invention therefore provides an effective solution for improving the surface condition of a part, in particular a metal part, and reducing its roughness, without requiring a large amount of abrasive product and/or solid medium, in a fast way.

Although a treatment method and device comprising only two dispensers have been described, it should be noted that the machine can be adapted to include several series of dispensers. This can in particular allow treating several surfaces of parts at the same time. It is possible to provide for having several pairs comprising a dispenser for the chemical etching and a dispenser for the rinsing, in series, to perform several consecutive passages on the same surface to be treated.

The invention claimed is:

1. A method for surface treatment of a part, the part comprising a surface to be treated, wherein the method comprises steps of:

charging a first dispenser with a chemical etching solution and charging a second dispenser with a rinsing solution, positioning the first dispenser and the second dispenser facing the surface to be treated, moving the first dispenser and the second dispenser along the surface to be treated, so that the surface to be treated successively receives the chemical etching solution and then the rinsing solution, wherein the first and second dispensers are positioned in a sealed casing configured to ensure sealing between the surface to be treated and areas of the part located out of the surface to be treated.

2. The treatment method according to claim 1, wherein the first dispenser and the second dispenser are positioned and moved relative to the surface to be treated so that the second dispenser is positioned in the wake of the first dispenser, so as to apply the rinsing solution in areas of the surface to be treated that have just received the chemical etching solution.

3. The treatment method according to claim 1, wherein the first dispenser and the second dispenser each comprise a roller or a brush, wherein the positioning step comprises bringing the first dispenser and the second dispenser into contact with the surface to be treated of the part.

4. The treatment method according to claim 3, wherein the first dispenser and the second dispenser are continuously charged respectively with the chemical etching solution and with the rinsing solution so as to remain impregnated during the application.

5. The treatment method according to claim 1, wherein the chemical etching solution is a solution with an acidic pH less than 5, or a basic pH greater than 9.

6. The treatment method according to claim 1, wherein the step of moving the first dispenser and the second dispenser lasts between 1 and 10 seconds per square millimeter of the surface to be treated.

7. The treatment method according to claim 1, in which moving the first dispenser and the second dispenser along the surface to be treated is configured to move together the first dispenser, the second dispenser and the sealed casing.

8. A device for surface treatment of a turbomachine part, the part comprising a surface to be treated, the device comprising:

a first dispenser configured to distribute a chemical etching solution, a second dispenser configured to distribute a rinsing solution, a support configured to hold the first dispenser in position relative to the second dispenser and allow a joint movement of the first dispenser and the second dispenser, movement means configured to allow simultaneous movement of the first dispenser and of the second dispenser along the surface to be treated so that the surface to be treated first receives the chemical etching solution and then the rinsing solution, and a sealed casing in which the first and second dispensers are positioned and configured to ensure sealing between the surface to be treated and areas of the part located out of the surface to be treated, the device being suitable to carry out the treatment method of claim 1.

9. The surface treatment device according to claim 8, further comprising:

means for conveying a chemical etching solution at the first dispenser, means for conveying a rinsing solution at the second dispenser, means for controlling a flow rate of the chemical etching solution and a flow rate of the rinsing solution.

10. The surface treatment device according to claim 8, wherein the first dispenser and the second dispenser each comprise a roller, and the device further comprises a recovery bin configured to recover an excess of chemical etching solution and an excess of rinsing solution at an outlet of the chemical etching roller and of the rinsing roller.

11. The surface treatment device according to claim 8 further configured to move together the first dispenser, the second dispenser and the sealed casing.

* * * * *